US005295935A

United States Patent [19]

Wang

[11] Patent Number: 5,295,935

[45] Date of Patent: Mar. 22, 1994

[54] STRETCHING DEVICE WITH RESILIENT RESISTANCE

[76] Inventor: Yuh-Ruenn Wang, No. 18, Pei Ping 2nd Rd., Taichung, Taiwan

[21] Appl. No.: 20,400

[22] Filed: Feb. 22, 1993

Related U.S. Application Data

[63] Continuation-in-part of Ser. No. 827,707, Jan. 27, 1992, abandoned.

[51] Int. Cl.[5] ..... A63B 21/04

[52] U.S. Cl. ..... 482/130; 482/123; 482/126; 482/907

[58] Field of Search ..... 482/907, 120, 123, 126, 482/129, 130, 133, 135, 139

[56] References Cited

U.S. PATENT DOCUMENTS

| | | | |
|---|---|---|---|
| 1,738,987 | 12/1929 | Dattilo | 482/130 |
| 1,750,549 | 3/1930 | Thomson et al. . | |
| 3,620,530 | 11/1971 | Cosby . | |
| 3,749,400 | 7/1973 | Stoffel | 482/130 |
| 3,992,004 | 11/1976 | Feron et al. | 482/130 |
| 4,111,417 | 9/1978 | Gardner | 482/130 |
| 4,239,212 | 12/1980 | Hickey | 482/126 |
| 4,506,884 | 3/1985 | Hankin | 482/130 |
| 4,645,204 | 2/1987 | Berger | 482/123 |
| 4,911,438 | 3/1990 | Van Straaten | 482/130 |
| 5,147,266 | 9/1992 | Ricard | 482/130 |

FOREIGN PATENT DOCUMENTS 2120110A 8/1982 United Kingdom .

*Primary Examiner*—Richard J. Apley
*Assistant Examiner*—Lynne A. Reichard
*Attorney, Agent, or Firm*—Bacon & Thomas

[57] ABSTRACT

An exercise device includes a pair of parallel tracks each having a shaft disposed in the middle portion, a pair of parallel poles slidably engaged on the shafts, springs biasing the poles away from each other, a pair of slides slidably engaged on the tracks, a number of elastic bands having one end fixed to each of the slides and the other end fixed to the tracks. The elastic bands are arranged such that the poles move toward each other against the springs when the slides are moved away from each other.

10 Claims, 15 Drawing Sheets

STRETCHING DEVICE WITH RESILIENT RESISTANCE

This is a continuation-in-part of application Ser. No. 07/827,707, filed Jan. 27, 1992, now abandoned.

BACKGROUND OF THE INVENTION

1. Field of the Invention

The present invention relates to an exercise device, and more particularly to a multi-purposes exercise device.

2. Description of the Prior Art

A typical exercise device is disclosed in U.S. Pat. No. 1,750,549 to Thomson et al., and includes a seat slidable along a track section, the device is not suitable for practicing leg stretching.

Another typical exercise device is disclosed in U.S. Pat. No. 3,620,530 to Cosby and includes a carriage slidable along a supporting frame, the device is not suitable for practicing body stretching, furthermore, an additional chair is required for practicing muscle groups of the legs.

Still another typical exercise device is disclosed in U.K. Patent Application No. 2,120,110 to Torii and includes a pair of foot boards moveable away from each other against the springs, however, the moving distance of the foot boards is limited by the springs such that the legs of the user can not be fully stretched.

The present invention has arisen to mitigate and/or obviate the afore-described disadvantages of the conventional exercising mechanisms.

SUMMARY OF THE INVENTION

The primary objective of the present invention is to provide an exercise device which is a multi-purposes exercise device suitable for practicing various groups of muscles of the users.

In accordance with one aspect of the invention, there is provided an exercise device comprising a pair of parallel tracks each including a beam disposed in a middle portion thereof, a shaft disposed in each of the beams, a pair of parallel poles slidably engaged on the shafts, means for biasing the poles away from each other, a pair of slides slidably engaged on the tracks and located oppositely beside the beams, and at least one resilient member including a first end fixed to each of the slides and engaged over a respective pole and a second end fixed to the tracks, the resilient members being arranged such that the poles are caused to move toward each other against the biasing means when the slides are moved away from each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
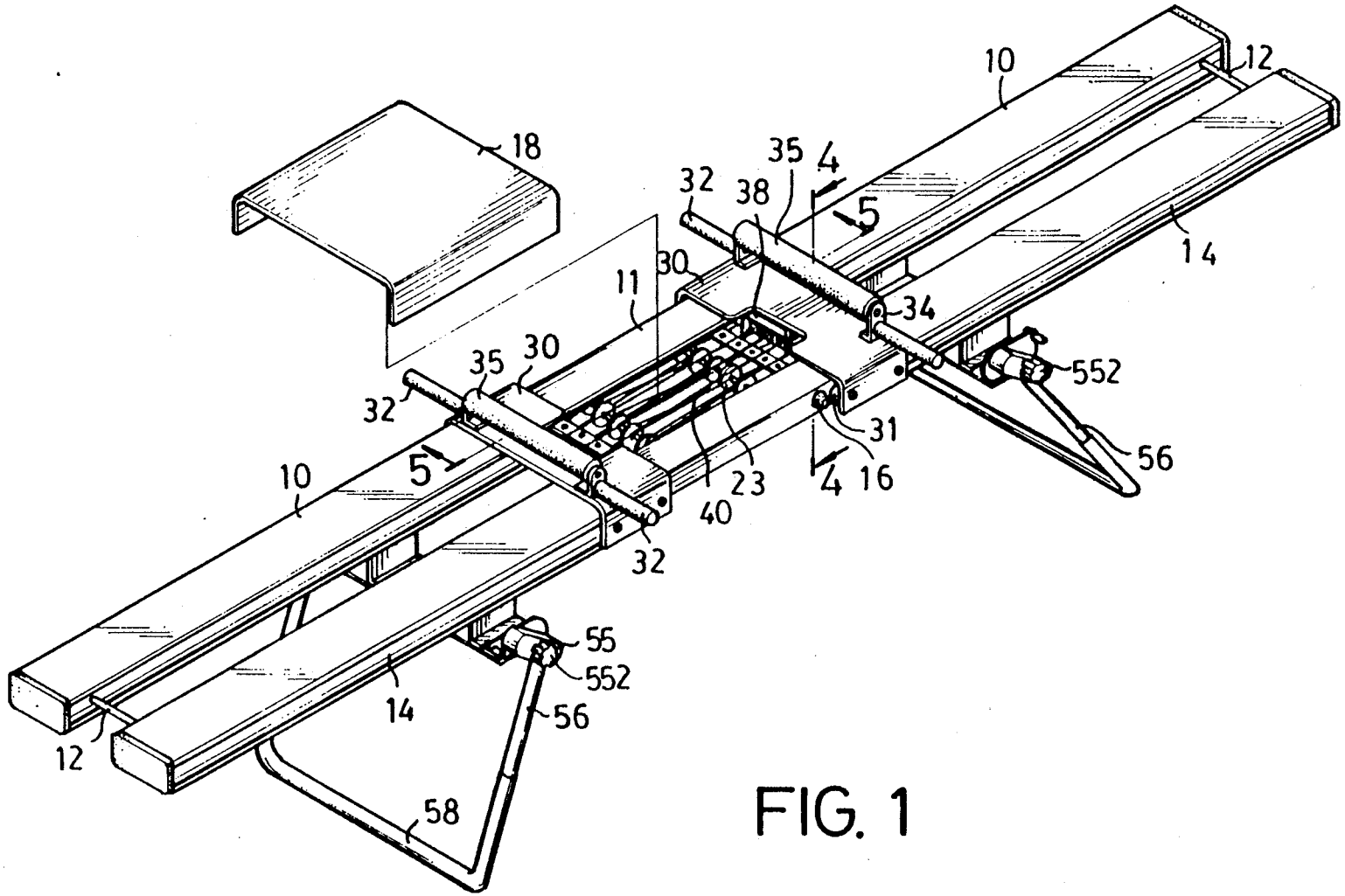
FIG. 1 is a partial exploded view of an exercise device in accordance with the present invention.
Figure 2:
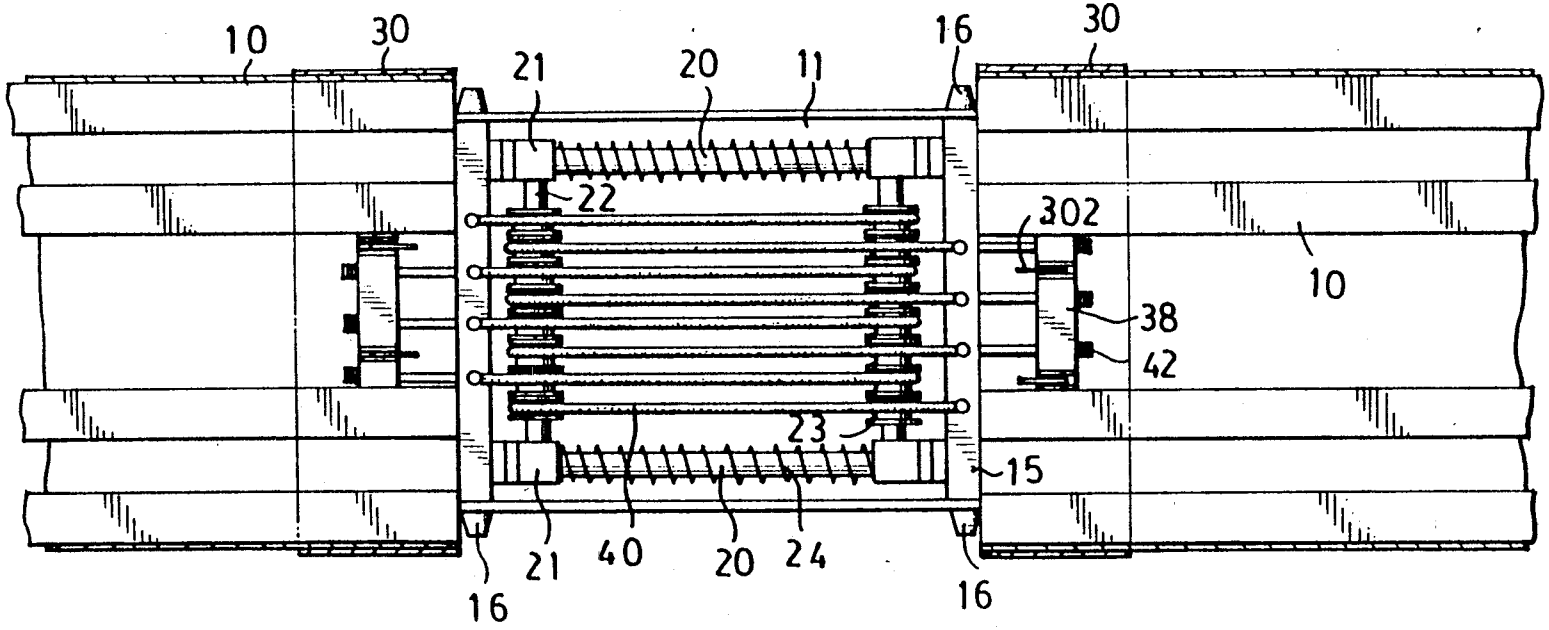
FIG. 2 is a bottom view of the exercise device.

Referring to the drawings, and initially to FIGS. 1 to 5, an exercise device in accordance with the present invention comprises a pair of tracks 10 disposed in parallel with each other and having the end portions coupled together by rods 12 and each including an L-shaped beam 11 formed in the middle portion thereof, a groove 14 longitudinally formed in the outer side of each of the tracks 10, a pair of parallel bars 15 (FIG. 2) fixed to the beams 11 and each including two end portions 16 extended outwards of the beams 11 so as to form a stop 16. A seat 18 is engaged on the beams 11 so as to form a seat portion for the users. As best shown in FIG. 2, a shaft 20 is disposed in each of the beams 11, two blocks 21 are slidably engaged on each of the shafts 20, a pair of poles 22 fixed between the shafts 20 and disposed in parallel with each other such that the poles 22 are slidable along the shafts 20, a plurality of pulleys 23 rotatably supported on each of the poles 22, and a spring 24 is engaged on each of the shafts 20 and biased between the blocks 21 so as to biasing the poles 22 away from each other. A plurality of resilient members, for example, as shown in the drawings, a plurality of elastic bands 40 each includes one end fixed to each of the bars 15 by bolts 41 (FIG. 5) and the other end having a hooking member 42 fixed thereon, the middle portions of the elastic bands 40 are engaged over the respective pulleys 23.

Figure 3:
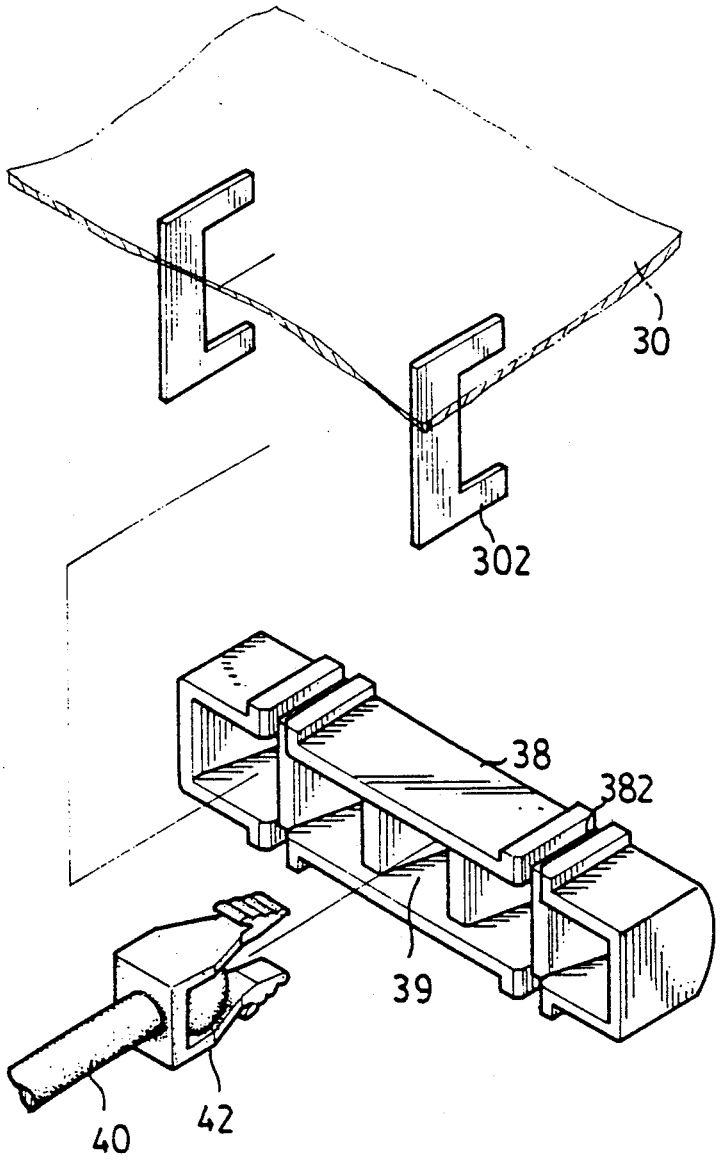
FIG. 3 is a partial exploded view illustrating the coupling of the resilient member.
Figure 4:
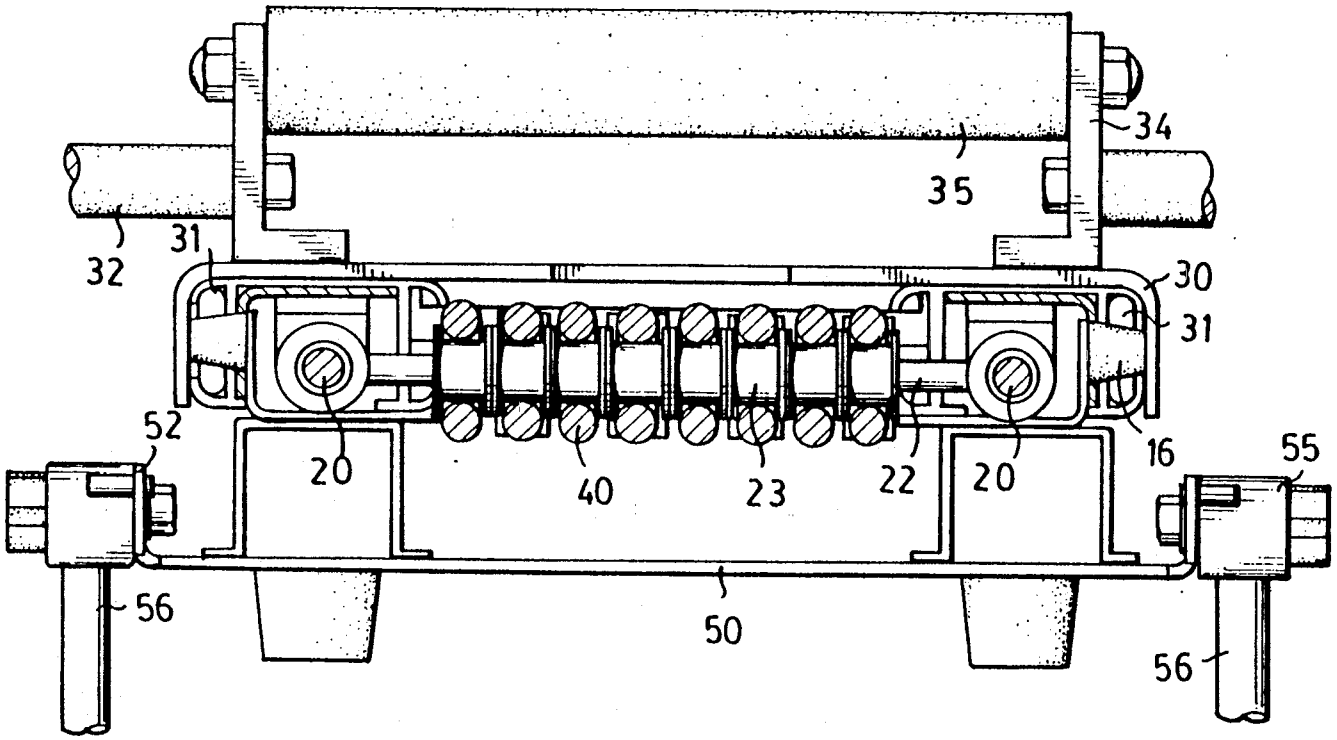
FIG. 4 is a cross sectional view taken along lines 4—4 of FIG. 1.
Figure 5:
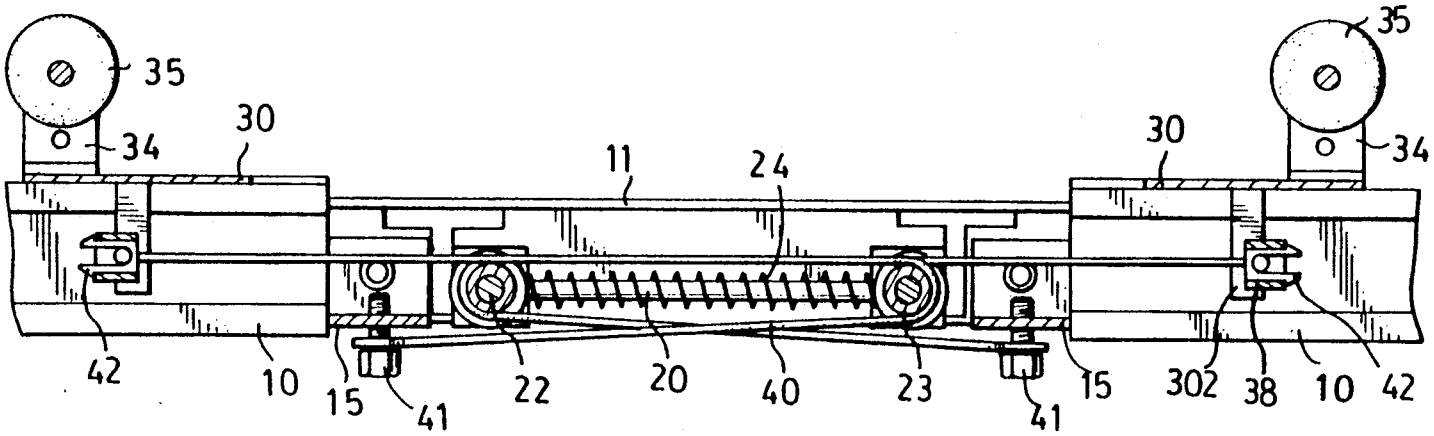
FIG. 5 is a cross sectional view taken along lines 5—5 of FIG. 1.
Figure 6:
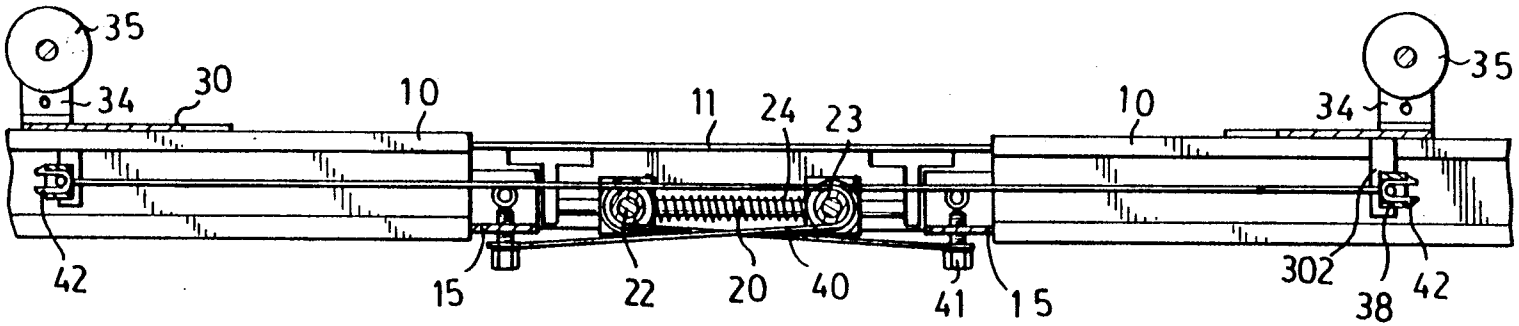
FIG. 6 is a cross sectional view similar to FIG. 5, illustrating the operation of the exercise device.

A pair of slides 30 are slidably engaged on the tracks 10 and oppositely disposed beside the seat 18, and each includes at least one roller 31 rotatably engaged in each of the grooves 14 such that the slides 30 are freely slidable along the tracks 10, the stops 16 are engageable with the rollers 31 so as to limit the movement of the slides 30, each of the slides 30 includes a pair of hand grips 32 laterally and oppositely extended outward therefrom, the hand grips 32 are preferably threadedly engaged to the slides 30 and may be dismounted from the slides 30, a support 33 and a bracket 34 are disposed on each of the slides 30, a hand grip 35 is supported in each of the brackets 34. As best shown in FIG. 3, a pair of retainers 302 are fixed to the bottom of each of the slides 30, a stick 38 includes a pair of channels 382 for engaging with the retainers 302 so that the stick 38 can be attached to each of the slides 30, each of the sticks 38 includes a plurality of holes 39 formed therein. The hooking members 42 of the elastic bands 40 are engaged in the respective holes 39 of the stick 38, the elastic bands 40 are arranged such that the poles 22 are caused to move toward each other against the springs 24 when the slides 30 are moved away from each other. The resiliences of the elastic bands 40 and the springs 24 provide the resistant forces against the slides 30 when the slides are moved away from each other (FIG. 6). It is to be noted that the slides 30 may be moved to the end portions of the tracks 10 and will not be obstructed by the springs or the elastic bands.

Figure 7:
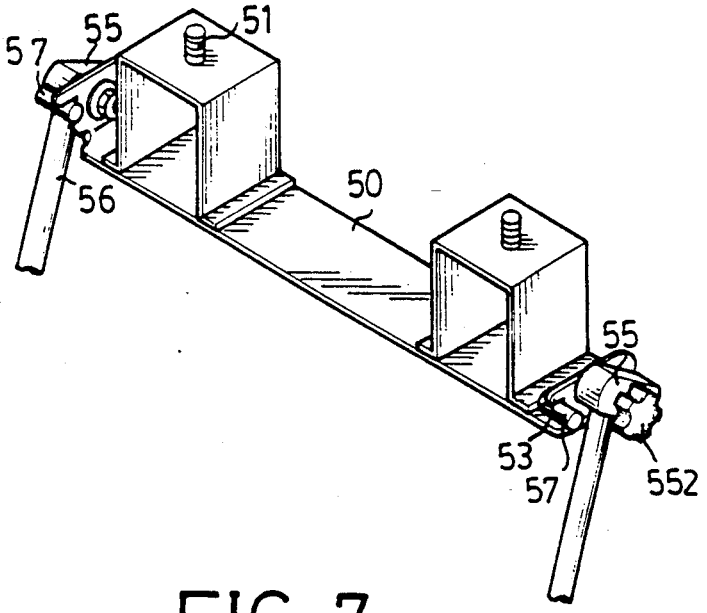
FIGS. 7 and 8 are perspective views illustrating the operations of the supporting members.
Figure 8:
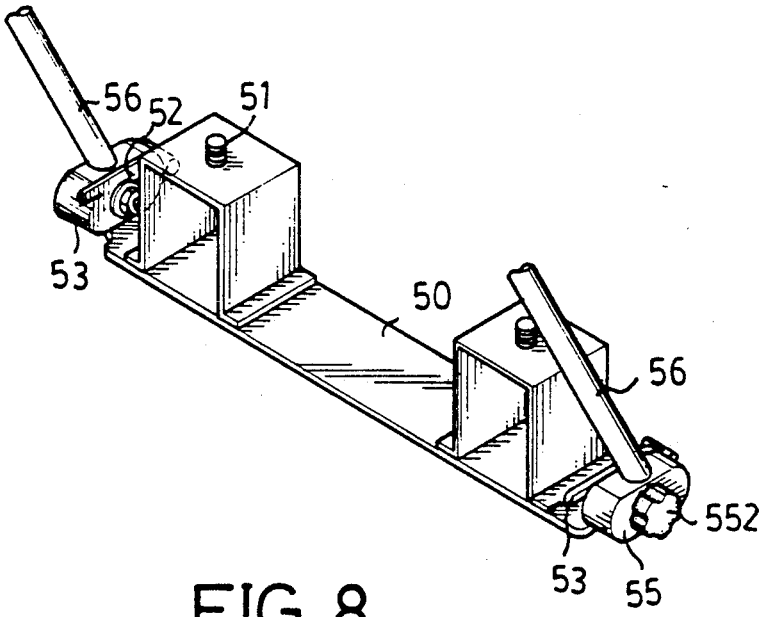
Figure 9:
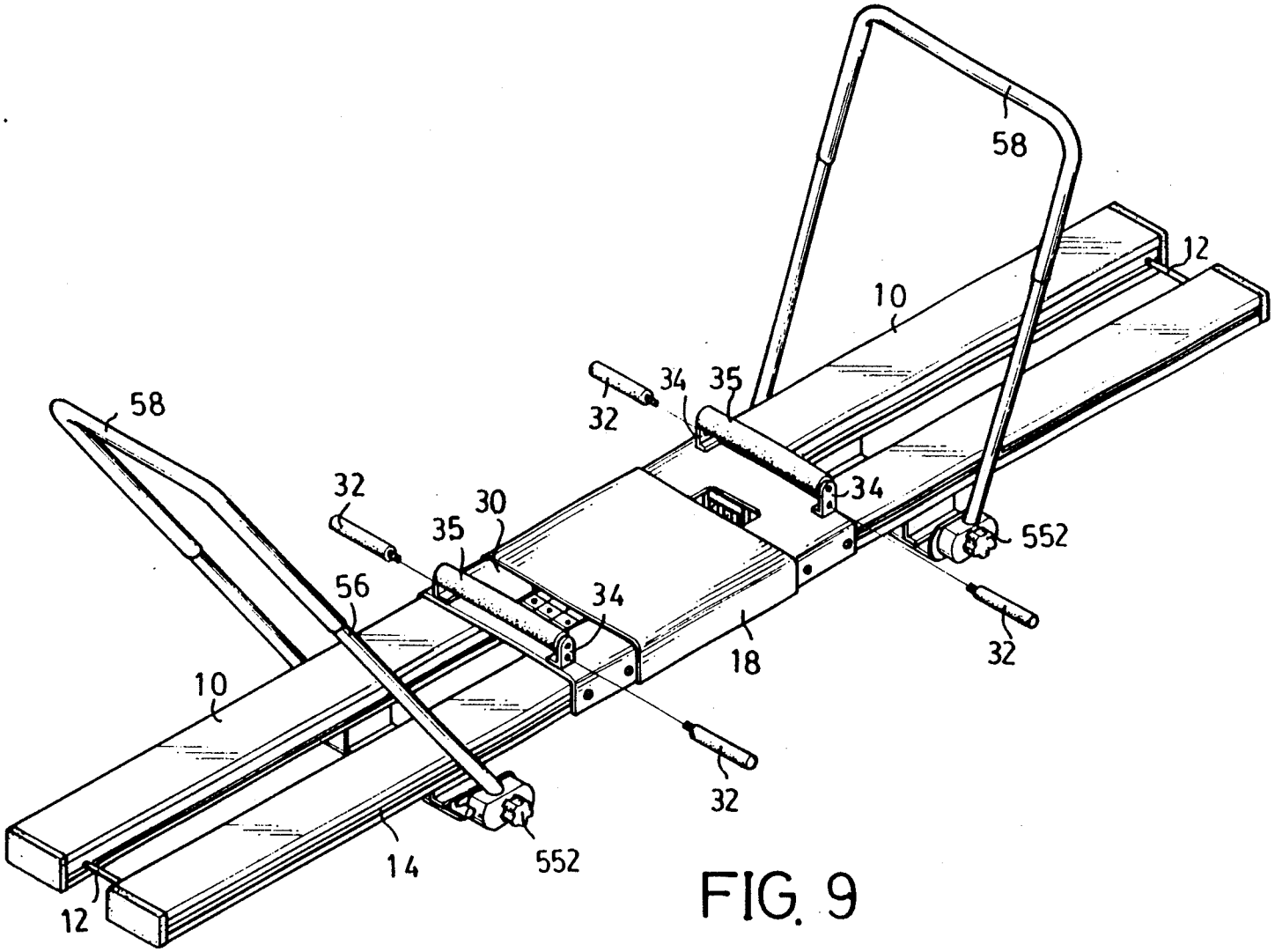
FIG. 9 is a perspective view of the exercise device, illustrating the operations of the supporting members.

Referring next to FIGS. 7 and 8, and again to FIG. 1, a pair of plates 50 are fixed in parallel to the tracks 10 by bolts 51 and extended perpendicular to the tracks 10, a flange 52 is formed in each end of each of the plates 50 and includes a catch 53 formed thereon. A head 55 is pivotally coupled to each of the flanges 52 and includes a leg 56 fixed thereto and an extension 57 extended therefrom for engagement with the respective catch 53 such that the legs 56 can be retained in the downward position, best shown in FIG. 1, and such that the exercise device can be elevated The head 55 can be fixed in place by a bolt 552. It is preferable that a post 58 is coupled between the free end portions of the legs 56 so as to form a supporting base of the exercise device. However, as shown in FIG. 9, when the legs 56 are rotated upward, the posts 58 may also form a pair of hand grips.

Figure 10:
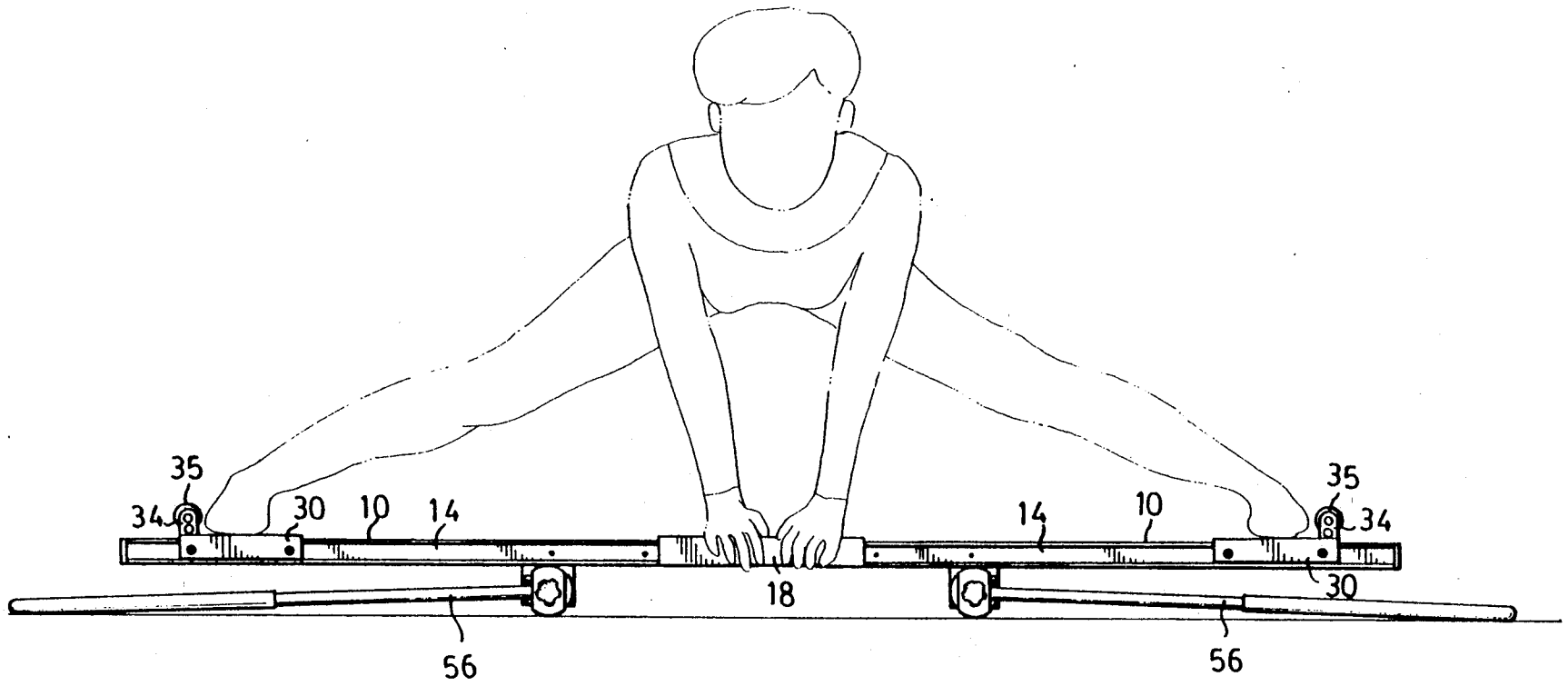
FIGS. 10, 11, 12, 13, 14, 15, 16 and 17 are schematic views illustrating the operations of the exercise device.
Figure 11:
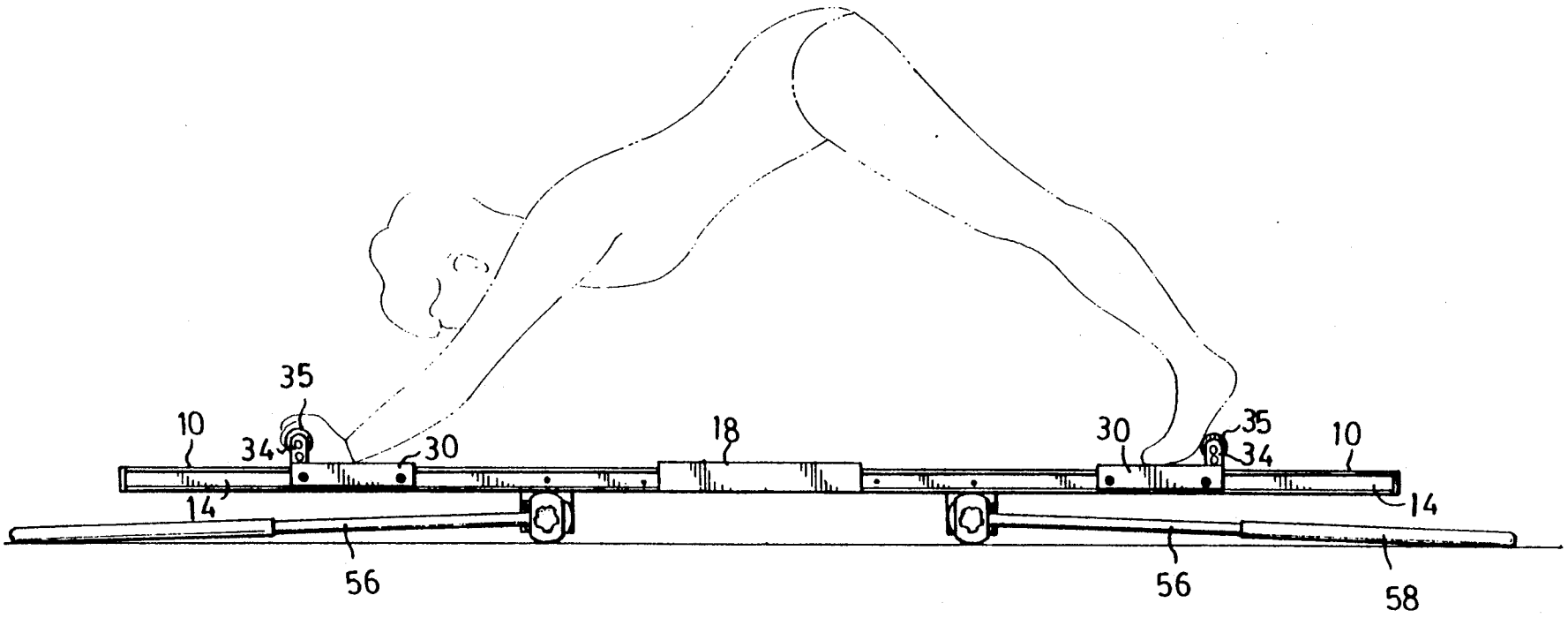
Figure 12:
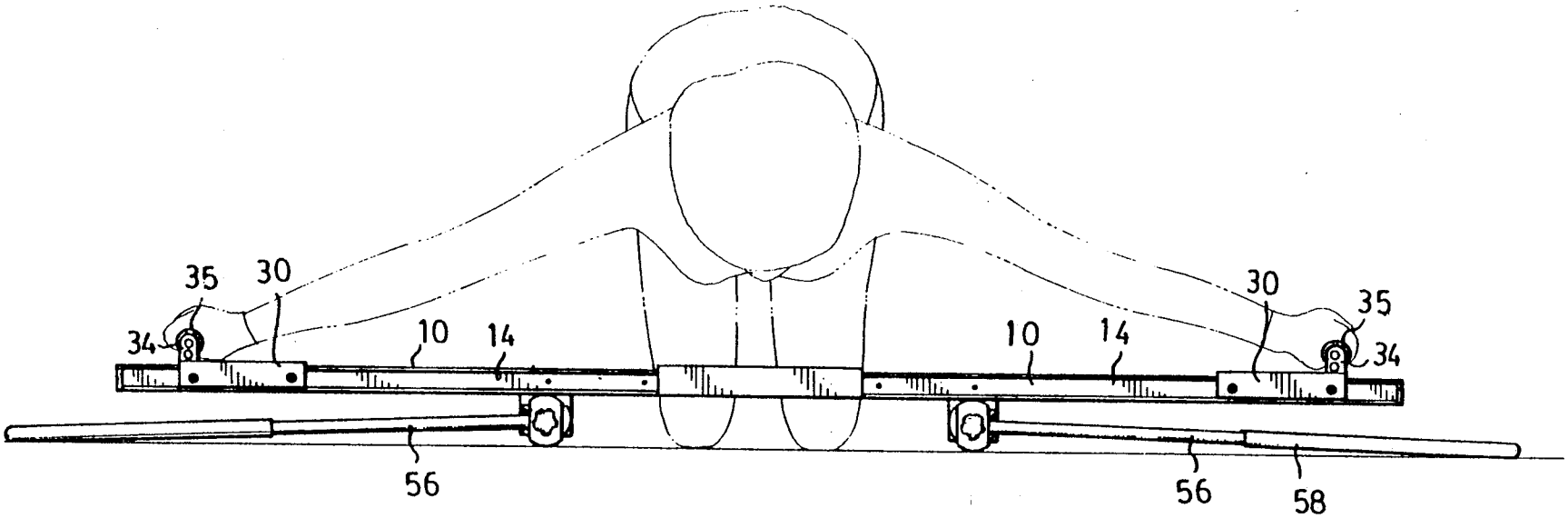
Figure 13:
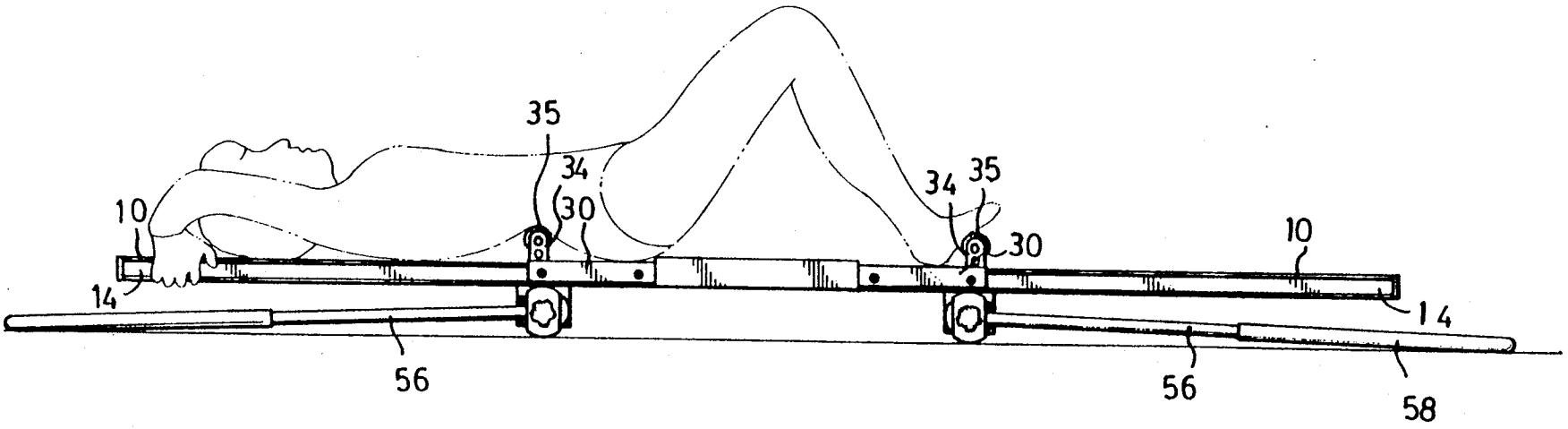
Figure 14:
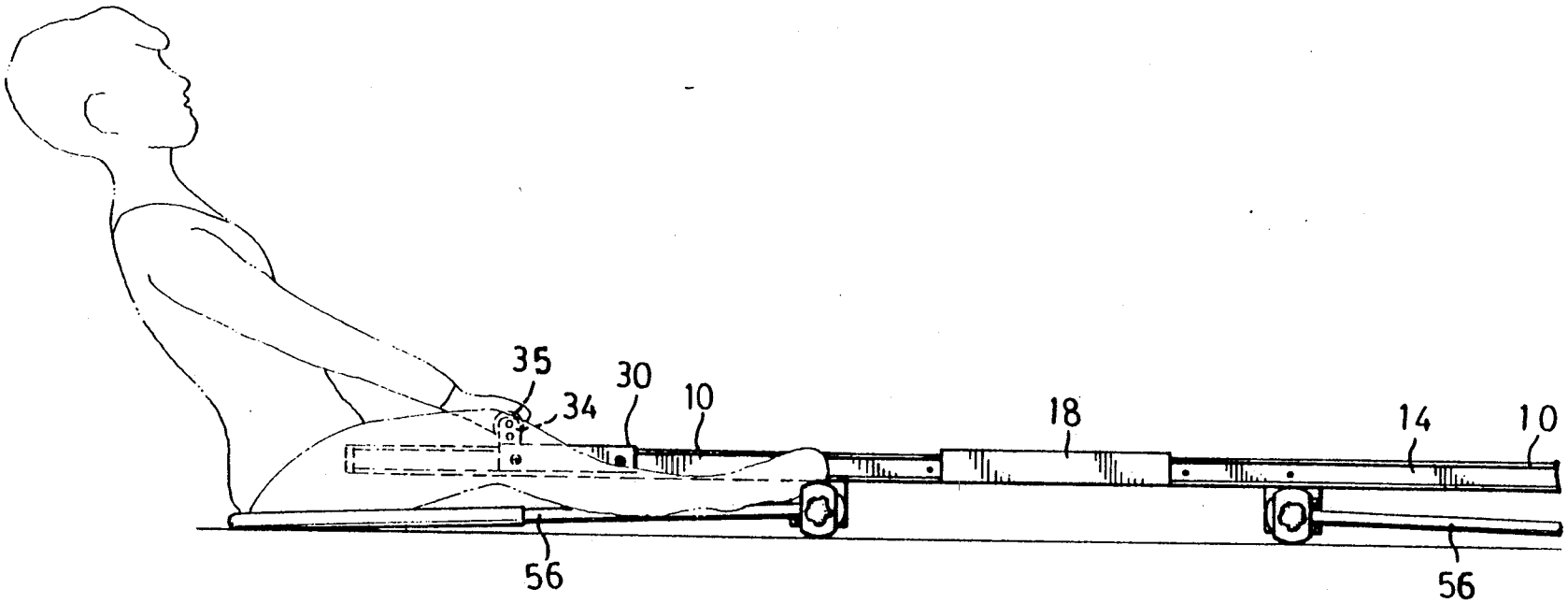
Figure 15:
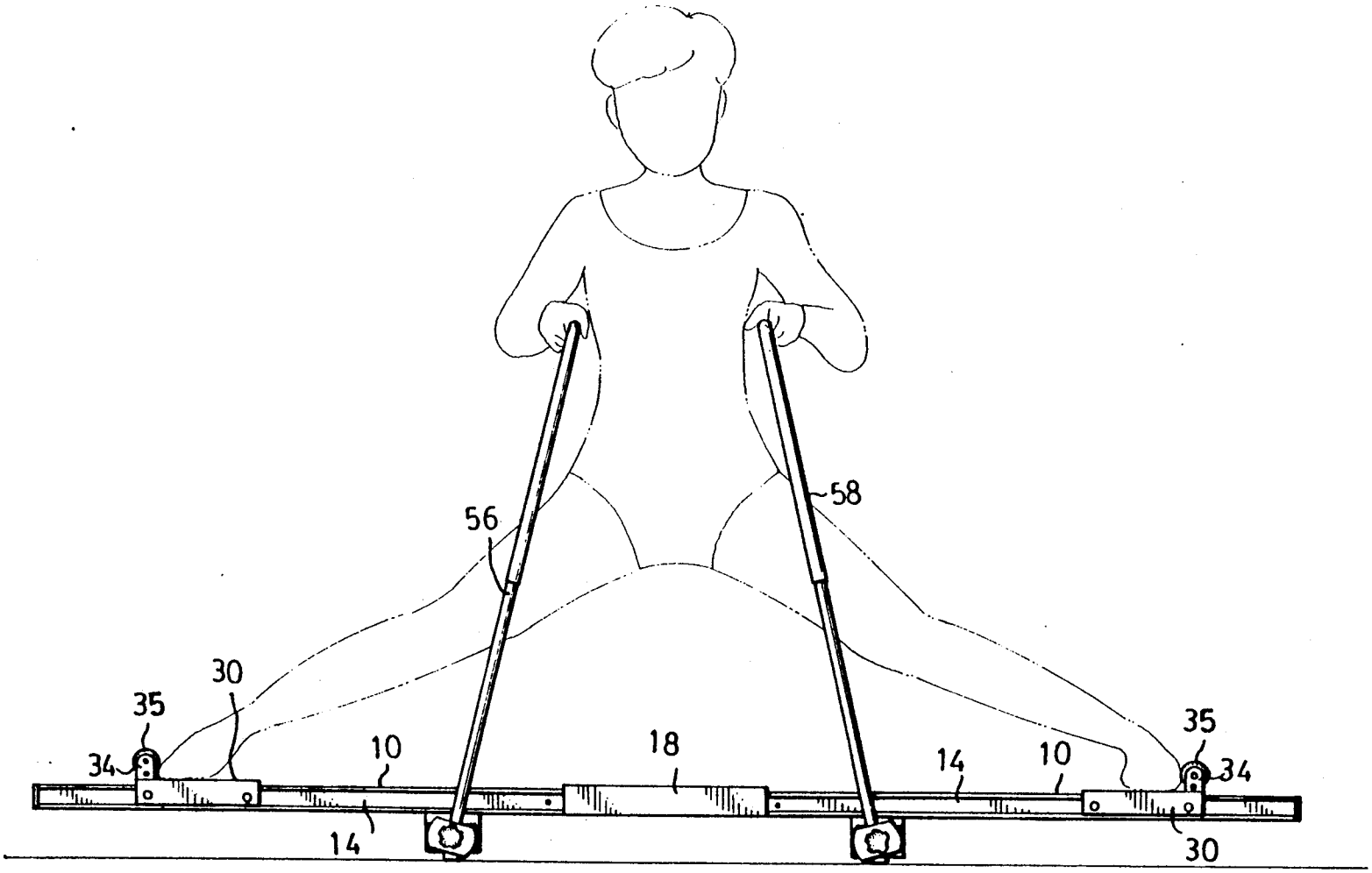
Figure 16:
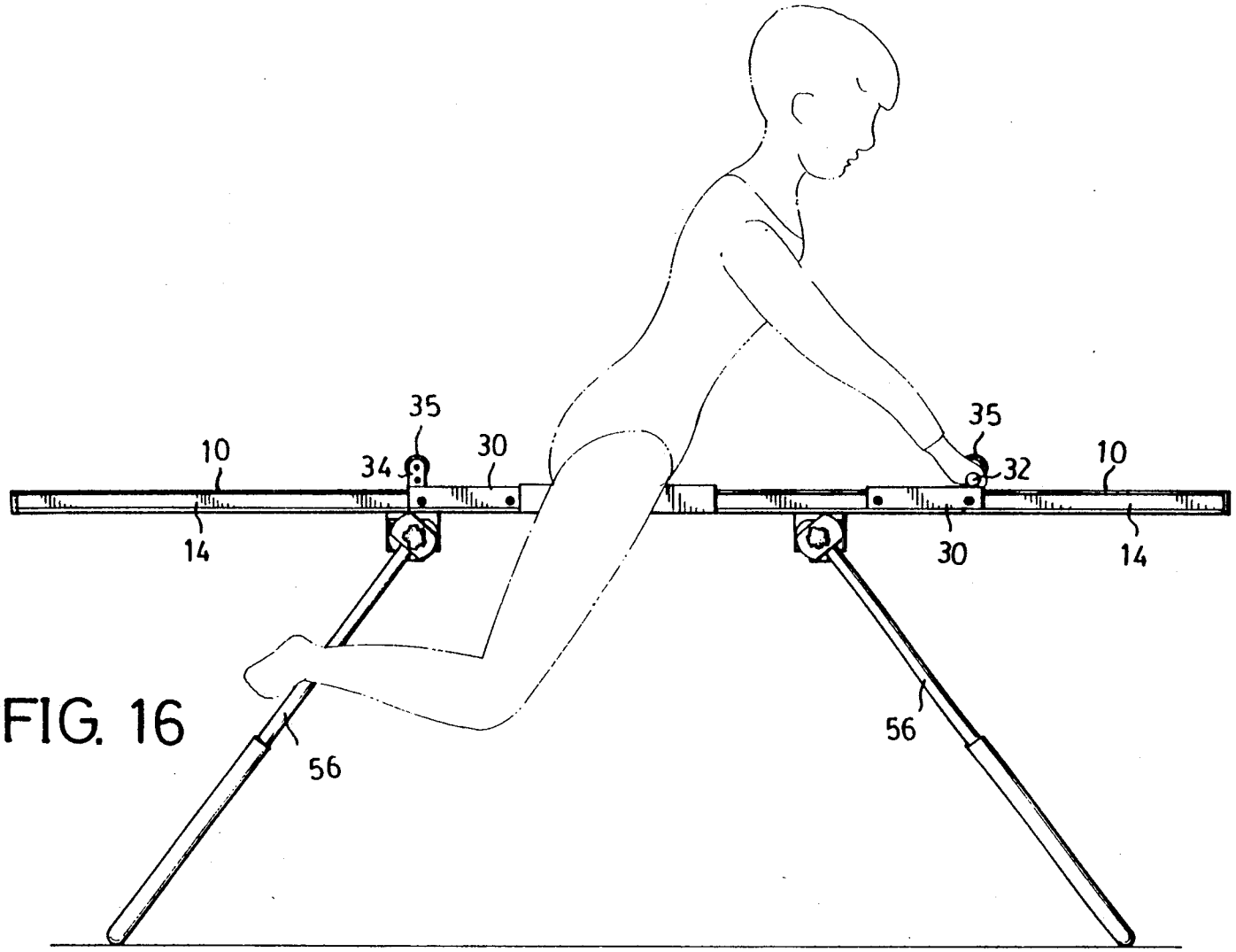
Figure 17:
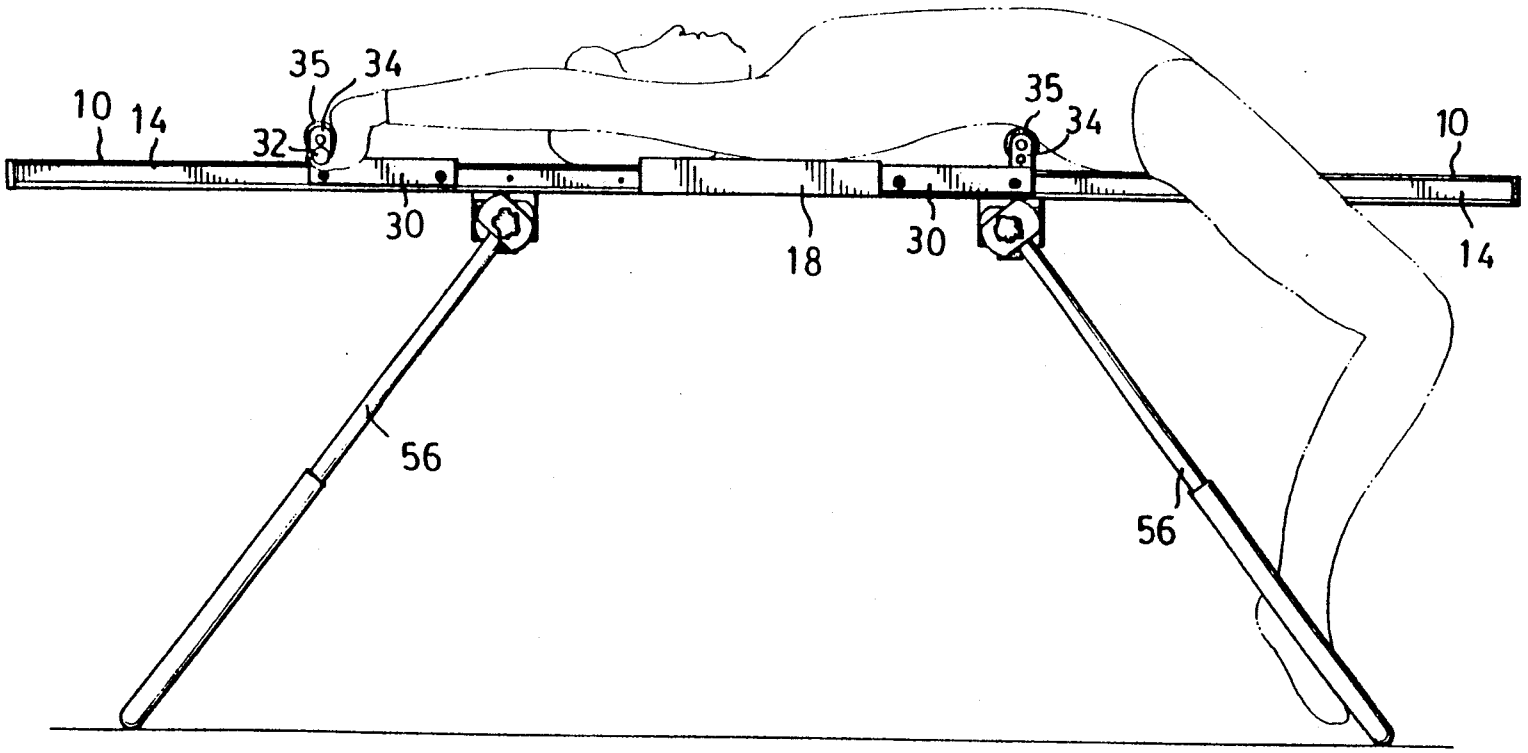

Referring next to FIGS. 10 to 17, in operations, the slides 30 may be moved to the end portions of the tracks such that the legs or the hands of the users may be fully stretched, best shown in FIGS. 10 to 12. As shown in FIGS. 13 and 14, the users may move only one of the slides 30 so as to practice only the lower or the upper muscle groups. As shown in FIG. 15, the legs 56 and the post 58 can be used as hand supports when the legs 56 are rotated upward of the tracks 10. It is to be noted that, at this moment, the hand grips 32 are removed such that the legs 56 will not be interfered by the hand grips and may rotate freely. As shown in FIGS. 16 and 17, the tracks 10 can be supported in a higher position by the legs 56 such that another type of exercise mechanism is formed. As shown in FIGS. 13 and 17, the hand grips 35 can be used as a massaging means. Obviously, from the drawings, the exercise device in accordance with the present invention can be provided for exercising almost all of the muscle groups of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise device comprising a pair of parallel tracks each including a beam disposed in a middle portion thereof, a shaft disposed in each of said beams, a pair of poles slidably coupled between said shafts and arranged in parallel with each other, means for biasing said poles away from each other, a pair of slides slidably engaged on said tracks and located at opposite end of said beams, and at least one resilient member including a first end fixed to each of said slides and engaged over a respective pole and a second end fixed to said tracks, said resilient members being arranged such that said poles are caused to move toward each other against said biasing means when said slides are moved away from each other.

2. An exercise device according to claim 1 further comprising a pair of parallel bars fixed between said beams, said second ends of said resilient members being fixed to the respective bars, a stick fixed in each of said slides, said first ends of said resilient members being coupled to the respective sticks.

3. An exercise device according to claim 2, wherein each of said sticks includes at least one hole formed therein, said first end of each of said resilient members includes a hooking device provided thereon for engagement in the respective hole of said sticks so as to couple said resilient members to said sticks of said slides.

4. An exercise device according to claim 1, wherein each of said poles includes at least one pulley rotatably engaged thereon for engagement with the respective resilient member.

5. An exercise device according to claim 1, wherein each of said slides includes a support disposed thereon for supporting the feet portions of the users.

6. An exercise device according to claim 1, wherein each of said tracks includes a groove formed in an outer portion thereof, each of said slides includes at least one roller rotatably engaged in each of said grooves such that said slides are freely rotatable along said tracks.

7. An exercise device according to claim 1 further comprising a pair of parallel plates fixed to said tracks, each of said plates including two end portions each having a flange formed thereon, a catch formed in each of said flanges, a head rotatably secured to each of said flanges and including an extension extended therefrom for engagement with the respective catch, a leg fixed to each of said head, said legs being retained in an erected position when said extensions of said heads are engaged with the respective catches in order to elevate said tracks.

8. An exercise device according to claim 7, wherein each of said plates includes a pair of legs coupled thereto, each pair of said legs includes a post coupled therebetween so as to form a hand grip when said legs are rotated upward of said tracks.

9. An exercise device according to claim 1, wherein each of said slides includes a pair of hand grips laterally extended outwards therefrom.

10. An exercise device according to claim 1 further comprising a seat disposed on said beams for supporting the user.

* * * * *